United States Patent [19]

Magourik

[11] Patent Number: 4,793,271

[45] Date of Patent: Dec. 27, 1988

[54] KNIFE HOLDER APPARATUS FOR CUT PILE TUFTING MACHINE

[75] Inventor: Ray O. V. Magourik, Dunlap, Tenn.

[73] Assignee: Tuftco Corporation, Chattanooga, Tenn.

[21] Appl. No.: 145,108

[22] Filed: Jan. 19, 1988

[51] Int. Cl.[4] ..... D05C 15/24

[52] U.S. Cl. ..... 112/80.6

[58] Field of Search ..... 112/80.6

[56] References Cited

U.S. PATENT DOCUMENTS 4,445,446 5/1984 Beasley ..... 112/80.6

4,693,191 9/1987 Card et al. ..... 112/80.6

*Primary Examiner*—Ronald Feldbaum

*Attorney, Agent, or Firm*—Harrington A. Lackey

[57] ABSTRACT

A knife holder apparatus for a cut pile tufting machine including a knife block fixed to a depending mast which is slidably mounted within a corresponding slot in the knife bar and a wedge clamp member adapted to clamp or lock the knife bar carrying a plurality of knives in an operative position relative to the knife bar in which the knives cooperatively engage their corresponding looper hooks. The knife holder apparatus supports the knives at their predetermined tension and pitch angles relative to the looper hooks and in a manner in which the knife holder module and knives may be easily and quickly removed and replaced.

7 Claims, 1 Drawing Sheet

KNIFE HOLDER APPARATUS FOR CUT PILE TUFTING MACHINE

BACKGROUND OF THE INVENTION

This invention relates to a cutting apparatus for a multiple needle cut pile tufting machine, and more particularly to a knife holder apparatus for a cut pile tufting machine.

Conventionally, the knives utilized in multiple-needle cut pile tufting machines for cooperation with looper hooks form cut pile tufts have been supported in individual knife blocks which are open on the sides and include tracks or guideways for engaging the opposite edges of each knife. Each knife block is provided with a rearward projecting cylindrical stud or rod which is adapted to be rotatably adjustably received in a corresponding hole in a knife bar. This structure permits the knives to be set at the desired tension angles relative to the looper hooks. The holes in the knife bars are disposed at angles to the transverse dimension of the knife bar, which are equal to the pitch angle of the knife blades relative to the looper hooks. Each knife is secured in its knife block by threaded set screws, threadedly received within the knife block for movement toward and away from direct engagement with the edge of each knife.

Other prior art knife holders include knife blocks capable of supporting a multiple numbers of knives, such as two, three, four or eight knives each. Furthermore, in some knife blocks, one set screw may be utilized to secure two knife blades, instead of one.

Examples of typical knife holders for multiple needle cut pile tufting machines are shown in the following U.S. Pat. Nos.: 3,277,852, Card, Oct. 11, 1966; 4,003,321, Card, Jan. 18, 1977; and 4,067,270, Short, Jan. 10, 1978.

Because of the continuous vibration of a multiple needle tufting machine during its operation, considerable stress is exerted upon the rearward projecting cylindrical studs or rods in the typical knife blocks causing the knife blocks to rotate, in turn causing the knives to lose their proper tension angles with their cooperating looper hooks.

Several attempts have been made to provide knife holder apparatus which will rigidly mount the knife blocks relative to the knife bar without depending entirely upon the rearward projecting studs from the knife blocks received within corresponding holes in the knife bar.

In the U.S. Pat. No. 3,757,709to Cobble, issued Sept. 11, 1973, although the rearward projecting stud and its cooperating hole are retained, nevertheless, angular channels or guideways are formed in the front face of the knife bar for receiving the back faces of the corresponding knife bars.

T-shaped slots, similar to the vertically disposed angular channels of the above Cobble U.S. Pat. No. 3,757,709 are incorporated in the face of the knife bar of the Card et al U.S. Pat. No. 4,608,934, issued Sept. 2, 1986, in order to accommodate an elongated bracket fixed to the knife holder and provided with laterally projecting lugs for slidable reception within the corresponding slots of the knife bar. In the Card et al U.S. Pat. No. 4,608,934, the rearward projecting stud is eliminated. However, the vertical slidable bracket is retained in position within its corresponding T-slot by detent set screws 41, 141, and 241. In the Card et al U.S. Pat. No. 4,608,934, the bracket is slidably moved upwardly through its corresponding slot. The upward movement of the bracket and knife holder is arrested when the blades are in their operative position cooperating with the looper hooks, any an arresting pin 38 or arresting set screw 141 or 241. The set screws 41 rely upon their capability of engaging the pack surface 33 of the T-slot when tightened, in order to lock the corresponding bracket and its knife holder in its operative position relative to the knife bar.

SUMMARY OF THE INVENTION

It is therefore an object of this invention to provide in a multiple-needle cut pile tufting machine a cutting apparatus including a knife holder module having a depending mast slidably received within a corresponding slot formed in the front face of the knife bar, an improved means for retaining the knife holder module in its operative position relative to the knife bar. In the operative position of the knife holder, the knives are fixed in their cooperative relationship with the corresponding looper hooks, with the knife blades pre-set at their desired tension and pitch angles. The knife holder apparatus made in accordance with this invention includes a knife holder module comprising a knife block or block member supporting a plurality of knives at predetermined angles relative to the knife bar, and a mast fixed to and depending from the rear of the knife block. The mast is provided with opposed laterally projecting flanges adapted to be slidably received within corresponding recesses in the side walls of a slot formed in the face of the knife bar. The mast is retained in place within its corresponding slot by means of a wedge member or wedge clamp fitted into the slot behind the mast and pulled down into wedging engagement with the mast by means of an adjustable securing means such as a threaded bolt extending upward through the knife bar and into threaded engagement with the wedge member.

In the preferred form of the invention, the knife block member, per se, is substantially identical to that disclosed in the common assignee's U.S. Pat. No. 4,445,446, issued to Max M. Beasley on May 1, 1984.

Furthermore, preferably, an arresting pin is fixed in the lower portion of the mast to project rearwardly below the knife bar in order to arrest the upward movement of the mast and knife block member when the knives are in their operative position cooperating with their corresponding loopers for cutting yarn seized by the loopers during the tufting process.

Also, in a preferred form of the invention, the knife blocks, when mounted in their operative positions relative to the knife bar, are spaced forwardly of the front face of the knife bar to provide downward discharge openings for any lint collected on top of the knife bar and the knife blocks during the tufting operation.

Figure 2:
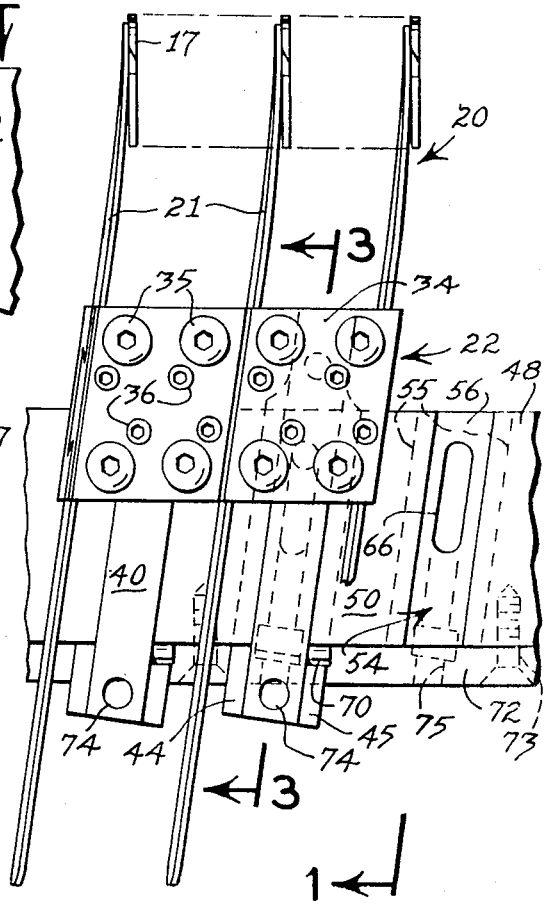
FIG. 2 is a fragmentary front elevational view taken along the line 2—2 of FIG. 1, without the needles; FIG.

3 is a fragmentary sectional elevation taken along the line 3—3 of FIG. 2; and

Figure 4:
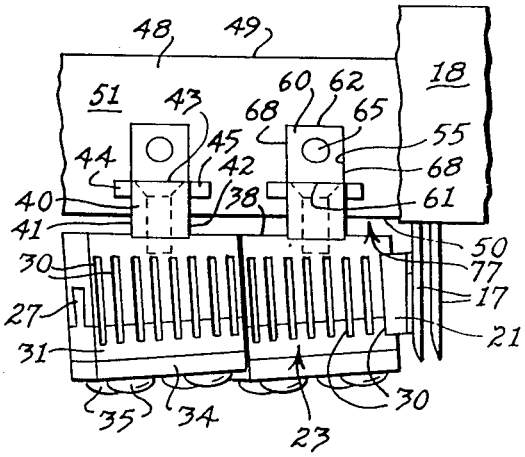
Figure 1:
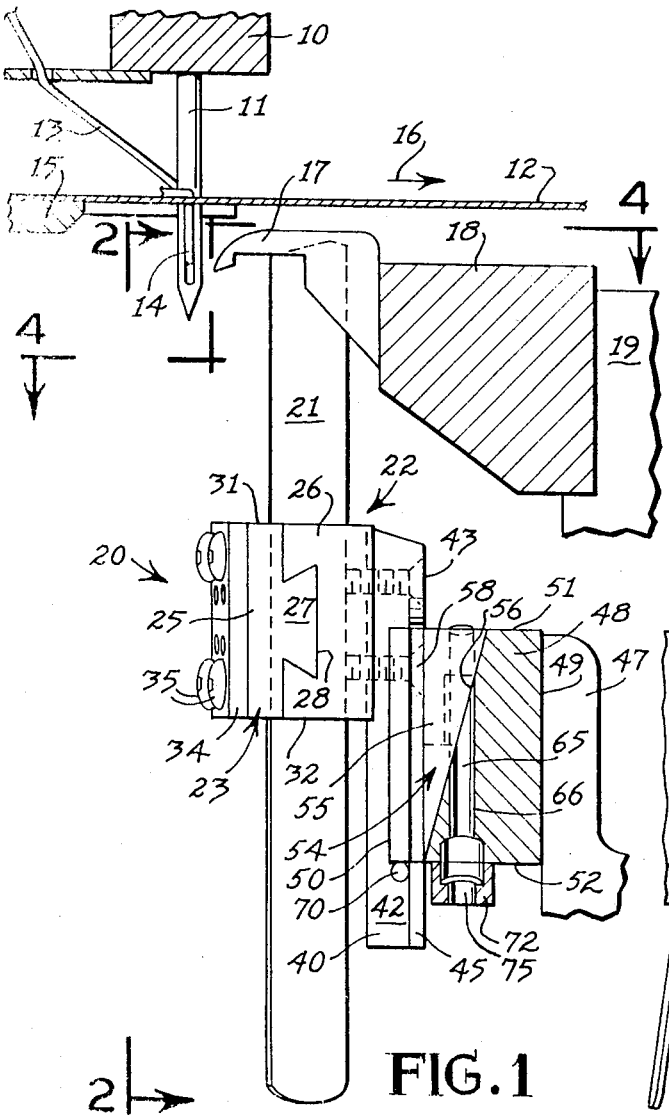
FIG. 1 is a fragmentary sectional elevation of a portion of a multiple needle cut pile tufting machine, taken along the line 1—1 of FIG. 2, illustrating the knife holder apparatus made in accordance with this invention, and illustrating the needles in loop forming positions penetrating the base fabric and the knives and looper hooks in their cutting positions.

FIG. 4 is a fragmentary plan view taken along the line 4—4 of FIG. 1.

DESCRIPTION OF THE PREFERRED EMBODIMENT

Referring now to the drawings in more detail, FIG. 1 discloses a transverse needle bar 10 in a conventional multi-needle tufting machine supporting a row of uniformly spaced needles 11 extending transversely of the machine. The needle bar 10 is vertically reciprocated by conventional means, not shown, to cause the needles 11 to move between an upper position above the base fabric 12 and a lower position penetrating the base fabric 12, so that the needles 11 will carry yarns 13 through the base fabric 12 to form loops 14 of tufting therein. The base fabric 12 is supported upon a needle plate 15 for movement, by means not shown, in the direction of the arrow 16 of FIG. 1, that is longitudinally in a feeding direction from front-to-rear through the machine.

Cooperating with each needle 11 is a cut pile looper hook 17. A plurality of the looper hooks 17 are carried in the transverse hook bar 18 fixed upon a plurality of transversely spaced brackets 19, which are in turn journaled upon a rock shaft, not shown, for reciprocal movement of the hook bar 18, in synchronism with the reciprocal movement of the needles 11.

The cutting apparatus 20 made in accordance with this invention includes a plurality of knives 21, each knife 21 being adapted to cooperate with a corresponding looper hook 17 for cutting the yarn loops 14 on the hooks to form cut pile tufts.

The cutting apparatus or knife holder apparatus 20 includes a knife holder module 22 in the form of a knife block member 23. The knife block member 23 is preferably constructed in the same manner as the knife block member in U.S. Pat. No. 4,445,446 incorporating a front section 25 and a rear section 26 secured together by a cooperating transverse tongue 27 and a transverse cooperating groove 28. The knife block member 23 is solid throughout, except for the transversely spaced elongated upright or vertically disposed knife slots 30. Each knife slot 30 has a width-wise dimension only slightly greater than the width of each corresponding knife 21. The thickness of each knife slot 30 is substantially equal to the thickness of each corresponding knife 21, so that each knife 21 has a snug sliding fit, to permit each knife 21 to be vertically moved by hand relative to the corresponding knife slot 30. Thus, each knife 21 is completely surrounded by, and substantially engages, solid material in the block member 23, so that each knife 21 has firm, solid reinforced support throughout the vertical extent of the knife portion within its corresponding knife slot 30.

The knife slots 30 extend parallel to each other and substantially vertically through the full height of the block member 23 and open through the top surface 31 and the bottom surface 32 of the block member 23.

As described in the prior Beasley U.S. Pat. No. 4,445,446, the face surface of the front block section 25 is covered by a cap plate 34 secured by the bolts 35. Formed through the cap plate 34 are also a plurality of set screws or clamp elements 36 aligned with the front edges of each pair of knives 21 received in the knife slots 30 for retention of the knives 21 in place within each knife block members 23.

Attached to the rear surface 38 of the knife block member 23, by threaded bolts 39 or other appropriate securing members, is the upper portion of a depending mast 40. The mast 40 has a height substantially greater than the height of the knife block member 23 and has a preferably rectangular or square cross-section defining a pair of opposed side surfaces 41 and 42 and a rear surface 43. Projecting transversely outwardly from the opposite side surfaces 41 and 43, respectively, are a pair of substantially coplanar elongated slide flanges 44 and 45.

Mounted upon plurality of knife brackets 47 (FIG. 1) for reciprocable motion upon a knife shaft, not shown, in synchronous relation with the movement of the hook bar 18 and the needle bar 10, is an elongated transverse knife bar 48 having a rear face 49, a front face 50, a top face 51 and a bottom face 52.

Figure 3:
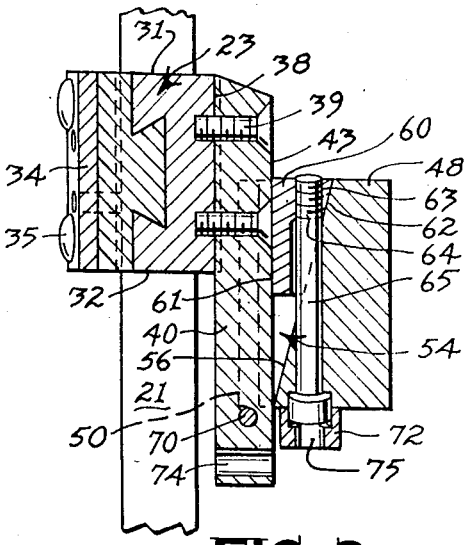

Formed in the front face 50 are a plurality of transversely spaced upright slots 54. Each slot 54 is formed with a pair of opposed parallel, side walls 55 connected by a rear wall 56 which slopes downward and forward from the top face 51 of the knife bar 49, as illustrated in FIGS. 1 and 3. Formed in the opposite side walls 55 of the slot 54 are a pair of opposed elongated slide recesses 58 which open through the top wall 51 and the bottom wall 52 of the knife bar 48. The dimensions of the slide recesses 58 are such that they will snugly, but slidably receive the opposing flanges 44 and 45 of the mast 40 for upward and downward slidable movement. The slot 54 projects rearwardly from the slide recesses 58 so that at least the upper portion of the back wall 56 is spaced from the rear surface 43 of the mast 40 when the mast 40 is received within its corresponding vertical slot 54.

When the mast 40 is received in its corresponding slot 54 and the mast 40 and block member 23 have been elevated to the operative position of the knife holder module 22, as disclosed in FIG. 1, with the top cutting edge of each knife blade 21 cooperating with the looper hook 17 for cutting the yarn loops 14, a wedge-member 60 having the same corresponding shape as the open space within the top portion of the slot 54 is inserted into the slot 54 behind the mast 40, and is thrust downward until the wedge member 60 firmly engages the rear surface 43 of the mast 40 and the back wall 56 of the slot 54 to clamp, wedge, or lock the mast 40 within its corresponding slot 54. As best disclosed in FIGS. 3 and 4, the wedge member 60 has a substantially vertical front face 61 and a forwardly declining rear surface 62 for engaging 14 flush against the respective rear surface 43 of the mast 40 and the declining rear wall 56 of the slot 54. The side walls 68 of the wedge member 60 are parallel and preferably slidably engage the corresponding side walls 55 of the slot 54.

In order to retain the wedge member 60 within the slot 54, it is provided with an internally threaded hole 63 for receiving the threaded end 64 of an elongated securing fastener or bolt 65 extending upwardly through a mating bolt hole 66 in the knife bar 48, as illustrated in FIGS. 1 and 3.

In order to limit the upward movement of the mast 40 within its corresponding upright slot 54 to the operative position of he knife holder module 22, an arresting pin 70 is fixed in one side surface 42 of the mast 40 to project laterally from the mast 40 at a predetermined position for engaging the bottom face 52 of the knife bar 48. When the knife module 22 has been arrested in its uppermost operative position, the knives 21 are in cutting engagement with their corresponding looper hooks 17, as illustrated in FIGS. 1, 2, and 3.

When the knife modules 22 are in their operative positions, the rear face 38 of each knife block 23 is spaced forwardly a predetermined distance from the front face 50 of the knife bar 48 to provide a lint discharge opening 77.

If desired a keeper member 72 may be secured to the bottom face 52 of the knife bar 48 by screws 73 (FIG. 2) for holding the clamp bolts 65 in place, as disclosed.

If desired, a hole 74 may be formed in the lower portion of the mast 40, extending front-to-rear, as illustrated in FIGS. 2 and 3, to permit insertion of a hook or lanyard through the hole 74 to assist in pulling or jerking the mast downward from its corresponding slot 54, if assistance to remove the module 22 is required.

As disclosed in the drawings, each of the upright slots 54 is disposed at an angle to the vertical equal to the desired tension angle, such as 8 degree of each knife relative to the vertical plane of its corresponding looper hook 17. As illustrated in FIG. 4, each of the soots 30 in the respective knife blocks 23 are disposed at an angle to the transverse axis of the knife bar 48, which is equal to the predetermined pitch angle of the blades 21 with reference to the vertical plane of their corresponding cooperating looper hooks 17, in a well known manner. An example of a pitch angle would be approximately 4 deg. Both the tension and pitch angles are provided to effect a scissors cutting action between each knife 21 and its corresponding looper hook 17.

In the operation of the cutting apparatus 20, each knife holder module 22 may be removed from the knife bar 49 by unthreading each clamp bolt 65 from its wedge member 60 while the keeper member 72 holds the bolt 65 in place within the hole 66, thus forcing each corresponding wedge member 60 upward away from wedging engagement with the rear surface 43 of the mast 40. The bolt 65 may be unthreaded from the wedge member 60 by inserting an Allen wrench, not shown, through an insert hole 75 within the keeper member 72 and into a corresponding recess within the head of a corresponding bolt 65.

The mast 40 is then manually .lowered through its corresponding slot 54 to completely remove the knife module 22 from the knife bar 48. If it is desired to move or replace any of the knives 21, the corresponding set screws 36 may be unscrewed to loosen the corresponding knives 21. When the knives 21 are removed from their corresponding knife block members 23, they may be replaced, or sharpened and re-inserted, and the set screws 36 re-tightened to lock the knives 21 in their respective block members 23.

Each module 22 is then placed below the knife bar 48 until the mast 40 is aligned with its corresponding upright slot 54. The module 22 is then raised, causing the flanges 44 and 45 of the mast 40 to slide upward along the registering slide recesses 58 until the top edges of the knives 21 approach the lower edges of the respective looper hooks 17. A tensioning tool, such as that disclosed in the Card et al U.S. Pat. No. 4,608,934 may be utilized to bend the knives 21 so that they clear the hooks 17 and can be raised between the hooks 17 and released into their cooperative cutting relationship with their corresponding looper hooks 17. At this point, arresting pins 70 will engage the bottom face 52 of the knife bar 48 to limit any further upward movement of the knife module 22.

The keeper member 72 is provided with a plurality of longitudinally spaced insert holes 75, each insert hole being in axial alignment with a corresponding bolt 65. An Allen wrench, not shown, is inserted through an insert hole 75 and into a corresponding recess, not shown, in the head of a corresponding bolt 65, and turned to thread the bolt 65 within the threaded hole 63 of the wedge member 60, causing the wedge member to move downward within the slot 54. The wedge member 60 continues to move downward until it is firmly wedged between the back wall 56 of the slot 54 and the rear surface 43 of the corresponding mast 40 to clamp the mast 40 within the knife bar 48.

The knife module 22 is then in its locked or clamped operative position for cooperation with its corresponding looper hook 17 when the machine is operated to cause the synchronized reciprocation of the needles 11, the looper hooks 17, and the knives 21.

The cutting apparatus 20 made in accordance with this invention facilitates accessibility to the knives and knife blocks for inspection, repair and maintenance below the machine and permits rapid removal and insertion of the multiple knives 21 in their operative positions upon the knife bar 48.

The cutting apparatus 20 made in accordance with this invention provides a structure for firmly holding the knives at their predetermined compound cutting angles with respect to the looper hooks 17 for long periods of time during continuous operation of the tufting machine incorporating such cutting apparatus 20.

The wedge member 60 provides a clamping member which has substantially more bearing and clamping surface to hold the knife holder module 22 within the knife bar 48 than previously known securing devices for knife holders.

What is claimed is:

1. In a cut pile tufting machine having means for supporting a base fabric for longitudinal movement in a feeding direction through said machine, a plurality of transversely spaced reciprocal needles for introducing yarns through said base fabric to form loops, a looper hook for each needle on the opposite side of the base fabric from the needles and adapted to cooperate with a corresponding needle to seize and hold a yarn carried by the needle to form a loop, a cutting apparatus comprising:

(a) a knife holder module comprising a knife block member having front and rear portions and top and bottom portions, and an elongated mast having upper and lower end portions and opposed side surfaces, (b) a plurality of elongated knife slots extending upright through said block (c) a plurality of elongated knives, each knife being received in a corresponding knife slot, (d) securing means in said block member for engaging and holding each knife in said corresponding knife slot to project above said knife block member, (e) said upper end portion of said mast being fixed to the rear portion of said knife block member so that said lower end portion of said mast depends below said knife block member, (f) a flange projecting transversely away from each of said opposed side surfaces of said mast, (g) an elongated knife bar mounted below said looper hooks for cooperative reciprocable movement with said looper hooks, said knife bar having a front face, a top face, and a bottom face, (h) an upright slot for each mast formed through the front face of said knife bar and extending through said top and bottom faces, (i) each slot having a pair of opposed parallel side walls spaced apart a distance substantially equal to the transverse dimension of said corresponding mast, and a back wall connecting said side walls and sloping from said top face toward said bottom face, (j) a pair of opposed parallel elongated recesses in said side walls opening through said bottom face for slidably receiving said corresponding flanges for positioning said knife holder module in an operative position relative to said knife bar, said recesses being spaced forward of said back wall, (k) a wedge member receivable in said slot between said back wall and said mast in said operative position, and (l) securing means for holding said wedge member in said slot in said operative position.

2. The invention according to claim 1 further comprising stop means for limiting the upward movement of said mast in said knife bar to said operative position in which said knives are in cutting engagement with their corresponding looper hooks.

3. The invention according to claim 2 in which said stop means comprises an arresting pin fixed to the lower end portion of said mast and projecting rearwardly beneath said knife bar.

4. The invention according to claim 1 in which said securing means comprises threaded bolt means extending through said knife bar and threadedly engaging said corresponding wedge member in an operative position for clamping said mast to said knife bar.

5. The invention according to claim 1 in which each of said slots is disposed in said knife bar at an angle equal to the desired tension angle of said corresponding knife blades.

6. The invention according to claim 5 in which each of said knife slots is disposed at an angle to the transverse axis of said knife bar equal to the pitch angle of said corresponding knife blades.

7. The invention according to claim 1 in which said rear portion of said knife block member is spaced forward of said front face of said knife bar in said operative position to provide a lint discharge opening between said knife block member and said knife bar.

* * * * *